US005151671A

United States Patent [19]

Hirao et al.

[11] Patent Number: 5,151,671

[45] Date of Patent: Sep. 29, 1992

[54] CIRCUIT BREAKER

[75] Inventors: Akihiko Hirao; Tomoyuki Sawada; Shinji Takayama; Youichi Aoyama; Yukihiro Matsuoka; Tatsuo Hiroshima, all of Kadoma, Japan

[73] Assignee: Matsushita Electric Works, Ltd., Japan

[21] Appl. No.: 658,506

[22] Filed: Feb. 21, 1991

[30] Foreign Application Priority Data

| | | | |
|---|---|---|---|
| Feb. 23, 1990 | [JP] | Japan | 2-43382 |
| Apr. 24, 1990 | [JP] | Japan | 2-112443 |
| May 22, 1990 | [JP] | Japan | 2-133533 |

[51] Int. Cl.[5] ..... H01H 9/00

[52] U.S. Cl. ..... 335/172; 335/167; 335/6; 335/21

[58] Field of Search ..... 335/6, 17, 23-25, 335/35, 167-175, 21-22

[56] References Cited

U.S. PATENT DOCUMENTS

| | | | |
|---|---|---|---|
| 3,254,176 | 5/1966 | Gelzheiser | 335/172 |
| 3,742,402 | 6/1973 | Nicol et al. | 335/17 |
| 4,616,199 | 10/1986 | Oster | 335/35 |
| 5,003,139 | 3/1991 | Edds et al. | 335/35 |

*Primary Examiner*—Lincoln Donovan
*Attorney, Agent, or Firm*—Leydig, Voit & Mayer

[57] ABSTRACT

A circuit breaker includes a compressive turning spring hung between a movable contact arm pivoted at an end to a handle rotatably mounted to a first reference position and a cradle pivotably mounted to a second reference position and disengageably locked to an abnormal current detection and trip mechanism. Under normal operation of the breaker, the turning spring exerts a contact pressure between movable and fixed contacts. Upon detection of an abnormal current, the turning spring is caused to turn so as to open the contacts. With this arrangement, the dispositions of constituent elements and their interlocking assembly can be simplified.

11 Claims, 4 Drawing Sheets

CIRCUIT BREAKER

BACKGROUND OF THE INVENTION

This invention relates generally to circuit breakers and, more particularly, to a circuit breaker having a manual contact opening and closing means as well as an abnormal current detection and trip means for appropriately operating an opening and closing contact means.

DESCRIPTION OF RELATED ART

A circuit breaker of the kind referred to is disclosed in U.S. Pat. No. 4,056,798. In that Patent, a circuit breaker comprises a manual contact operating means, a trip mechanism which serves as an abnormal current detection and trip means, and an opening and closing contact means. The manual contact operating means includes a handle and a cradle coupled to the handle for relative rotation. The cradle is interlocked through a tension spring with a movable contact arm of the contact means and is brought at one end into a locking engagement with the trip mechanism, which includes a bimetallic member which is released upon detection of an abnormal current, so that manual rotation of the handle against a spring force of the tension spring causes the movable contact arm to be rocked and the contact means to be operated to open or close contacts. When an abnormal current is caused to flow through the circuit breaker, on the other hand, the bimetallic member in the trip mechanism is thereby caused to be bent to release the one end of the cradle from the locking engagement with the trip mechanism, whereby the spring force of the tension spring is caused to act on the movable contact arm so as to displace it in a direction tending to open the contacts, and the opening and closing contact means is forcibly tripped from a contact closing state to contact opening state.

In such a circuit breaker however, the use of the tension spring requires that assembly work of respective constituent members be performed while establishing a tensile force between the cradle and the movable contact arm, so the disposition of the constituent members and their interlocking assembly are complicated. Further, since the tension spring is easily caused to be entangled in hooks or the like during automatic assembly, it has been difficult to employ automatic parts feeding, for the spring and the use of the tension spring in general has rendered automatic assembly difficult. Further, since the direction in which the force of the tension spring acts during a tripping operation due to detection of an abnormal current is substantially vertical, there has been a problem that the tension spring force has to be made larger when it is intended to enlarge the contact opening force acting on the movable contact arm upon the tripping operation, and the ease of assembly is decreased as the tension spring force is increased.

SUMMARY OF THE INVENTION

A primary object of the present invention is, therefore, to provide a circuit breaker which allows the disposition of the constituent members and their interlocking assembly to be easily performed and which therefore makes automatic assembly practical.

According to the present invention, this object can be realized by providing a circuit breaker in which a handle pivoted to a first reference position is provided with a coupling part, a movable contact arm is rotatably held at one end to the coupling part of the handle and has a first spring bearing part receiving a spring load, a movable contact is disposed on the other end of the movable contact arm for engaging with and disengaging from a fixed contact disposed on a fixed contact member, and a cradle pivoted to a second reference position and having a second spring bearing part receiving the spring load concurrently with the movable contact arm is releasably locked at a first locking part of the cradle to a second locking part of an abnormal current detecting means. A compressive turning spring exerting the spring load is hung between the first and second spring bearing parts of the movable contact arm and cradle. The turning spring exerts a contact pressure between the fixed and movable contacts when both contacts are in a closed state and the first locking part of the cradle is in locking engagement with the second locking part of the abnormal current detecting means, but it is caused to turn so as to rotate the movable contact arm and cradle in the direction of opening the movable contact from the fixed contact when the first locking part of the cradle is released from the second locking part of the abnormal current detecting means.

Other objects and advantages of the present invention will be made clear in the following description of the invention detailed with reference to preferred embodiments of the invention shown in the accompanying drawings.

Figure 1:
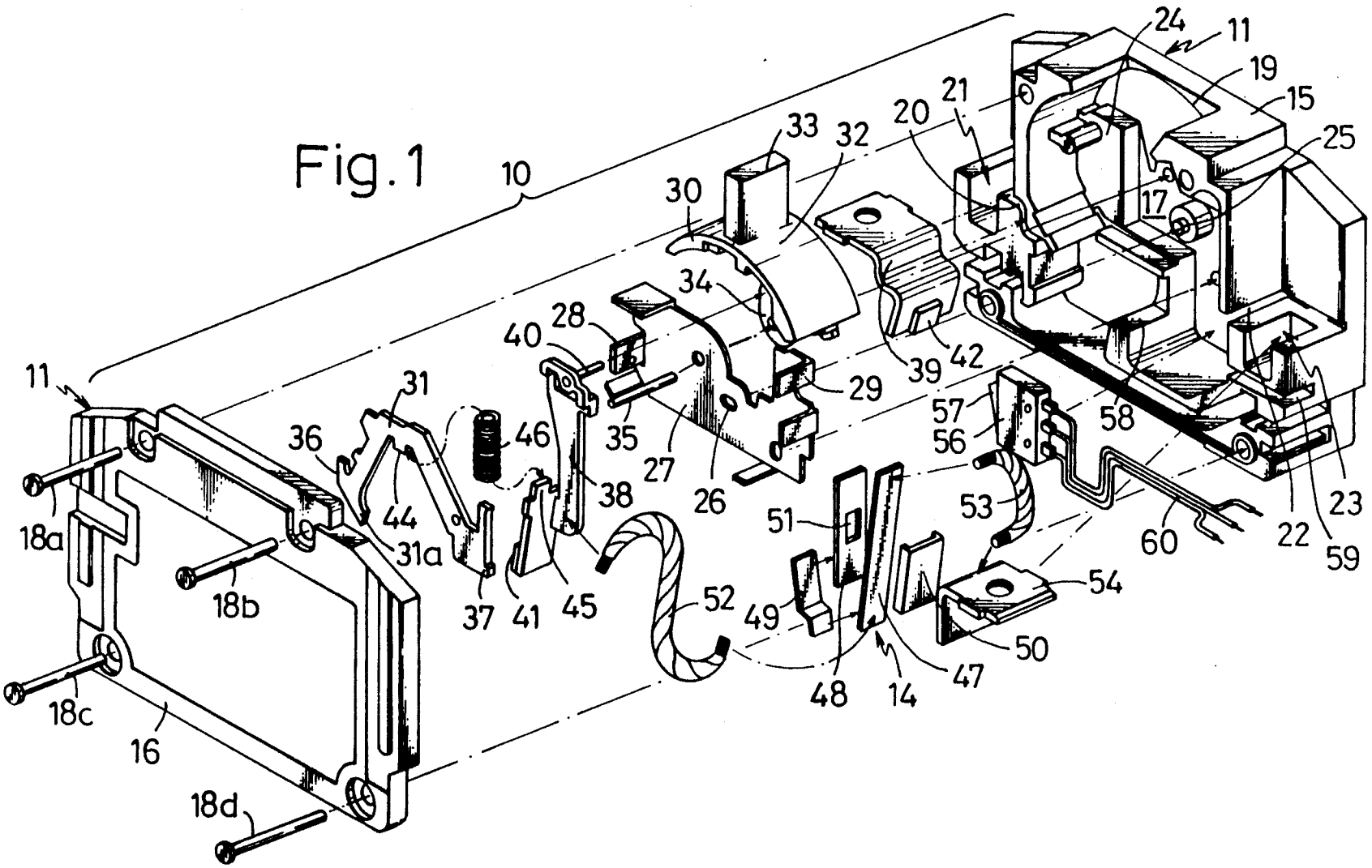
FIG. 1 is a perspective view of an embodiment of the circuit breaker according to the present invention, as disassembled.

While the present invention shall now be described with reference to the respective embodiments shown in the drawings, it should be appreciated that the intention is not to limit the invention only to these embodiments but rather to include all modifications, alterations and equivalent arrangements possible within the scope of appended claims.

DETAILED DESCRIPTION OF THE PREFERRED EMBODIMENTS

Referring to FIGS. 1 to 4, there is shown an embodiment of the circuit breaker according to the present invention. The circuit breaker 10 comprises in general a casing 11, a manual contact operating means 12, a switching contact means 13, and an abnormal current detecting means 14 constituting a trip mechanism.

The casing 11 consists of a casing body 15 opened on one side and a cover 16 fitted to the casing body 15 to close the open side. The casing body 15 defines therein a housing chamber 17 for the manual contact operating means 12, switching contact means 13 and abnormal current detecting means 14. The cover 16 is fixed to the casing body 15 with a plurality (four in the illustrated embodiment) of pins 18*a* to 18*d*, after incorporation of the respective foregoing means into the housing chamber 17. A handle projecting aperture 19, is formed in a top wall of the casing body 15, a guide channel 20 and a mounting part 21 for a terminal metal fitting carrying a fixed contact are formed in one longitudinal side wall of the casing body 15, and a guide slit 22 and the other mounting part 23 for a load side terminal metal fitting are formed in the other longitudinal side wall. In the housing chamber 17, a mounting frame 27 is disposed so as to be seated at one longitudinal end side preferably on a base 24 formed in the chamber 17 adjacent the one longitudinal side wall and so as to extend at the other longitudinal end side toward the other longitudinal side wall of the casing body 15 while engaging a mounting projection 25 erected at a central part of the housing chamber 17 into a corresponding hole 26 made in the frame 27. At the one longitudinal end of the frame 27 is provided a cradle-pivoting projection 28, and a further mounting projection 29 is provided at the other longitudinal end of the frame 27 for mounting the abnormal current detecting means 14.

The manual contact operating means 12 comprises a handle 30 and a cradle 31. The handle 30 is formed with a barrel part 32 having an arcuate surface which is slidable along an arcuate inside edge face of the aperture 19. The handle 30 also includes an operating knob 33 extending radially from the barrel part and projecting out of the aperture 19, while a base projection 34 projects downward from the barrel part 32. A pivoting hole is provided in the base projection 34, so that the handle 30 can be pivotably mounted at this base projection 34 by means of a shaft pin 35 passing through a hole in the mounting frame 27 at a position corresponding to the pivoting hole of the base projection 34 of the handle 30 and inserted at an end in a corresponding bearing recess made in the chamber 17 of the casing body 15, the pin 35 thus defining a first reference position. The cradle 31 comprises a plate member which is generally L-shaped and has on an inner side edge at one end a forcibly contact-opening leg 31*a* and on an outer side edge also at the one end a fulcrum part 36 pivoted to the cradle-pivoting projection 28 of the mounting frame 27, the projection 28 defining a second reference position. The other end has on its outer side edge a locking part 37 of the cradle intending toward the other longitudinal side end wall of the casing body 15, beyond the shaft pin 35 defining the first reference position, as seen in the front side elevation.

The switching contact means 13 comprises a movable contact arm 38 and a fixed contact plate 39. The movable contact arm 38 is coupled to the handle 30 for relative movement thereto by means of a pivot pin 40 fixed to top end portion of the arm 38 and inserted into a pin hole formed at corresponding position in the central part of the barrel part 32 of the handle 30. A movable contact 41 is secured to a lower end part of the arm 38. On the other hand, the fixed contact plate 39 is fixed inside the guide channel 20 formed on the one end side of the casing body 15. A fixed contact 42 is secured to an inner side end of the fixed contact plate 39 within the housing chamber 17 so that the movable contact 41 can engage and disengage therewith for contact switching. A terminal metal fitting 43 for connection with a power source is mounted to the other outer side end of the fixed contact plate 39 extending out of the housing chamber 17. The cradle 31 and movable contact arm 38 are provided at their mutually opposing central parts with spring bearing parts 44 and 45, respectively, and a compressive turning spring 46 is disposed between these bearing parts 44 and 45 so that, as will be detailed later, the movable and fixed contacts 41 and 42 are provided by the spring 46 with an optimum contact pressure when the switching contact means 13 is in the closed state under normal operation of the circuit breaker but the spring 46 turns to act on the movable contact arm 38 to separate the movable contact 41 from the fixed contact 42 when an abnormal current is detected.

The abnormal current detecting means 14 comprises a bimetal plate 47 and a tripping plate 48 of a magnetic material. The bimetal plate 47 is secured at a top end to the mounting projection 29 at the other longitudinal end of the mounting frame 27, and the tripping plate 48 is coupled at its lower end preferably through a spring plate 49 to a lower end of the bimetal plate 47. Substantially in the central part of the bimetal plate 47, an attracting plate 50 of a magnetic material having a substantially U-shaped section is secured. The tripping plate 48 is provided with a locking hole 51 for lockingly engaging the locking part 37 of the cradle 31 during the normal operation of the circuit breaker. The locking part 37 of the cradle 31 can be tripped out of the locking hole 51 when the tripping plate 48 is displaced onto the side of the bimetal plate 47 due to bending action of the bimetal plate 47 caused by magnetic attraction by the attracting plate 50 upon occurrence of the abnormal current. The bimetal plate 47 is connected through a connection line 52 made of a sufficiently flexible stranded wire to the movable contact arm 38. It is also connected through another similar connection line 53, to a load side terminal plate 54 which is mounted on the casing body 15 by being inserted into the guide slit 22 formed in the other longitudinal end wall of the body 15 and extends out of the housing chamber 17. A a terminal metal fitting 55 is mounted to the terminal plate 54, for connection of load thereto.

A detection switch 56 is disposed adjacent the lower part of the abnormal current detecting means 14. Preferably, a micro-switch is employed for this detection switch 56. An actuator 57 of this detection switch 56 is projects onto the side of the switching contact means 13 so that when the movable contact arm 38 is rotated in a direction so as to separate from the fixed contact plate 39 and eventually hit a stopper 58 projecting from the casing body 15, the movable contact arm 38 will be engageable with the switch actuator 57, the opening operation of the movable contact arm 38 and movable contact 41 can be detected by the detection switch 56, and a detection signal is transmitted, through lead wires 60 led out of the housing chamber 17 through a channel 59 of the housing body 15, to a proper indicating means (not shown). When the indicating means is installed at a position remote from the circuit breaker 10, it is possible to visually confirm the operating state of the circuit breaker 10 from the remote position.

An example of assembly of the circuit breaker according to the present invention shown in FIGS. 1 to 4 will now be described. Initially the fixed contact plate 39 is inserted into and fixed inside the guide channel 20 on the one end side of the casing body 15 having the mounting part 21 for the terminal metal fitting for the connection with the power source. Next, the shaft pin 35 is passed through the pivoting hole in the base projection 34 of the handle 30 and is engaged at one end into the bearing recess made at the first reference position in the casing body 15. Prior to incorporation into the casing body 15, an interior mounting assembly of certain constituent members is preliminarily prepared such that the top part of the bimetal plate 47 is secured to the mounting projection 29 of the frame 27, the attracting plate 50 is mounted to the central part of the bimetal plate 47, and the tripping plate 48 is coupled through the spring plate 49 to the base portion of the bimetal plate 47. Then, the movable contact arm 38 is connected to the base portion of the bimetal plate 47 with the connection line 52 between them, and the load side terminal plate 54 is connected to the top part of the bimetal plate 47 through the connection line 53. The thus prepared interior mounting assembly is now incorporated into the housing chamber 17 of the casing body 15, by inserting the other end of the shaft pin 35 into a hole made in the mounting frame 27 in alignment with the first reference position and engaging an erected end of the mounting projection 25 into the corresponding hole 26 in the mounting plate 27, so that the assembly is properly seated. At the same time, the load-side terminal plate 54 is inserted into and fixed to the slit 22 at the mounting part 23 for the load-side terminal at the other end wall of the casing body 15. Next, the pivot pin 40 secured to the top portion of the movable contact arm 38 is inserted into the pin hole made in the central part of the barrel part 32 of the handle 30. The fulcrum part 36 at one end of the cradle 31 is pivotably engaged to the cradle-pivoting projection 28 of the mounting frame 27, with the cradle-pivoting projection 28 defining the second reference position. The turning spring 46 is held in a compressed state between the opposing bearing parts 44 and 45 of the cradle 31 and the movable contact arm 38, and then the locking part 37 at the other end of the cradle 31 is engaged in the locking hole 51 of the tripping plate 48. Then, both side terminal metal fittings 43 and 55 are fitted to the fixed contact plate 39 and load-side terminal plate 54. The detection switch 56 is then installed so as to detect, by its actuator 57, the opening operation of the movable contact arm 38, and the lead wires 60 are led out of the channel 59 of the casing body 15. Finally, the contact opening and closing operation of the contact means 13 as well as the normal operating state of the tripping motion of the abnormal current detecting means 14 are tested, the cover 16 is then secured by the respective pins 18*a* to 18*d* to the casing body 15, and the assembly of the circuit breaker is completed.

Figure 2:
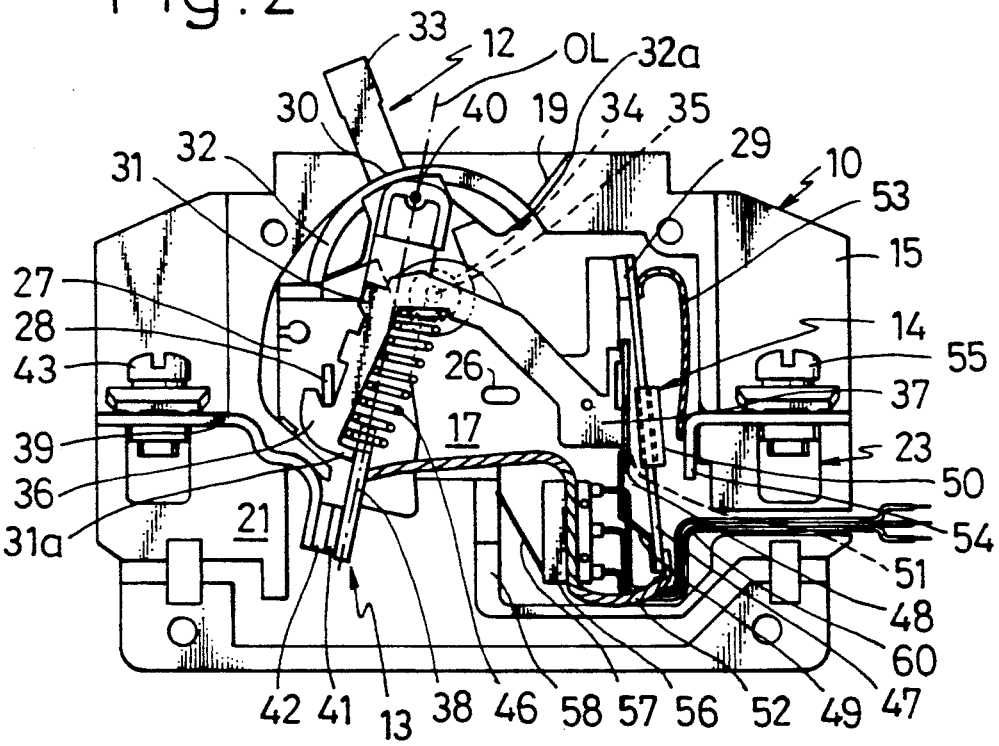
FIG. 2 is a front elevation of the circuit breaker of FIG. 1 showing its interior arrangement when the contacts are closed with a cover of the circuit breaker removed.
Figure 3:
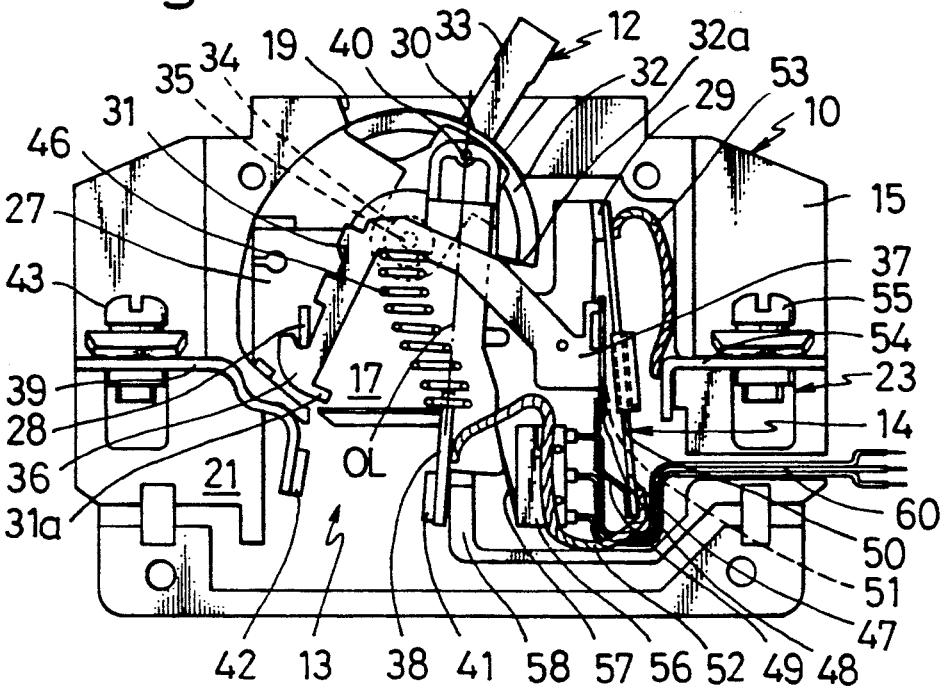
FIG. 3 is a similar front elevation of the circuit breaker of FIG. 1 showing the interior arrangement when the contacts are open.

The operation of the above-described circuit breaker 10 will now be described. The handle 30 is operated along the aperture 19 of the casing body 15 so that the handle 30 rotates about the shaft pin 35 as a fulcrum at the first reference position until the operating knob 33 of the handle 30 engages an end edge of the aperture 19. At this stage, the cradle 31 is in stationary state with the fulcrum part 36 at one end of the cradle 31 pivotably engaged to the cradle-pivoting projection 28 at the second reference position of the mounting frame 27 and with the locking part 37 at the other end of the cradle 31 engaged in the locking hole 51 of the tripping plate 48. The movable contact arm 38 which is interlocked through the compressive turning spring 46 with the cradle 31 and coupled through the pivot pin 40 to the position close to the barrel part 32 of the handle 30 which rockingly rotates about the shaft pin 35 as a fulcrum, is caused to rock so that the lower portion of the movable contact arm 38 will rock in the same direction as the operating knob 33 of the handle 30. As a result the movable contact 41 of the movable contact arm 38 is brought into contact with the fixed contact 42 of the fixed contact plate 39, as shown in FIG. 2, and the switching contact means 13 assumes the closed state. In this state, an operational line OL shown in FIG. 2 by a single-dot chain line, that is, a line connecting the pivot pin 40 and the spring bearing part 45 of the movable contact arm 38, is at a position shifted beyond the first reference position of the shaft pin 35 onto the side of the fixed contact plate 39, so that the spring force of the turning spring 46 exerts a desired contact pressure between the movable and fixed contacts 41 and 42, and the switching contact means 13 is stablized in the contact closing state.

When the handle 30 is operated in the opposite direction along the aperture 19 of the casing body 15, the handle 30 is rotated about the shaft pin 35 at the first reference position until one lower end 32*a* of the barrel part 32 engages an upper edge of the cradle, and the lower part of the movable contact arm 38 is caused to rock in a direction causing it to separate from the fixed contact plate 39 until the lower part of the arm 38 hits the stopper 58. As a result, as the operational line OL shifts back beyond the first reference position, the turning spring 46 is caused to turn from the position of FIG. 2 to a position shown in FIG. 3 where the movable contact 41 of the movable contact arm 38 is separated from the fixed contact 42 and the contact means 13 is stabilized in the contact opening state. At this moment, the opening operation of the movable contact arm 38 is detected through the actuator 57 by the detection switch 56, and the detection signal is transmitted therefrom through the lead wires 60 to the exterior.

In the event that an overcurrent exceeding a predetermined value is caused to continuously flow through the circuit breaker 10 in the closing state of the contact means 13, Joule heat thereby generated in the bimetal plate 47 raises the temperature of the bimetal plate 47 and causes it to bend, in response to which the tripping plate 48 is actuated through the spring plate 49 to be shifted in a direction causing it to separate from the switching contact means 13, the locking part 37 at the other end of the cradle 31 is thereby disengaged from the locking hole 51 of the tripping plate 48, and the cradle 31 is caused by the force of the compressive turning spring 46 in the state of FIG. 2 to rotate in the counterclockwise direction with the cradle-pivoting projection 28 as the fulcrum. In response to this rotation of the cradle 31, the forcibly contact-opening leg 31*a* of the cradle 31 urges the movable contact arm 38 to shift in the direction separating the movable contact arm 38 from the fixed contact plate 39 while the turning spring 46 is displaced at its upper end engaging the spring bearing part 44 of the cradle 31 and eventually the spring 46 is made to turn to so that its spring force acts on the movable contact arm 38 in the direction separating the movable contact 41 from the fixed contact 42 of the fixed contact plate 39, and the switching contact means 13 is thereby forcibly tripped from the contact closing state to a contact opening state shown in FIG. 4, that is, into a tripped state.

Figure 4:
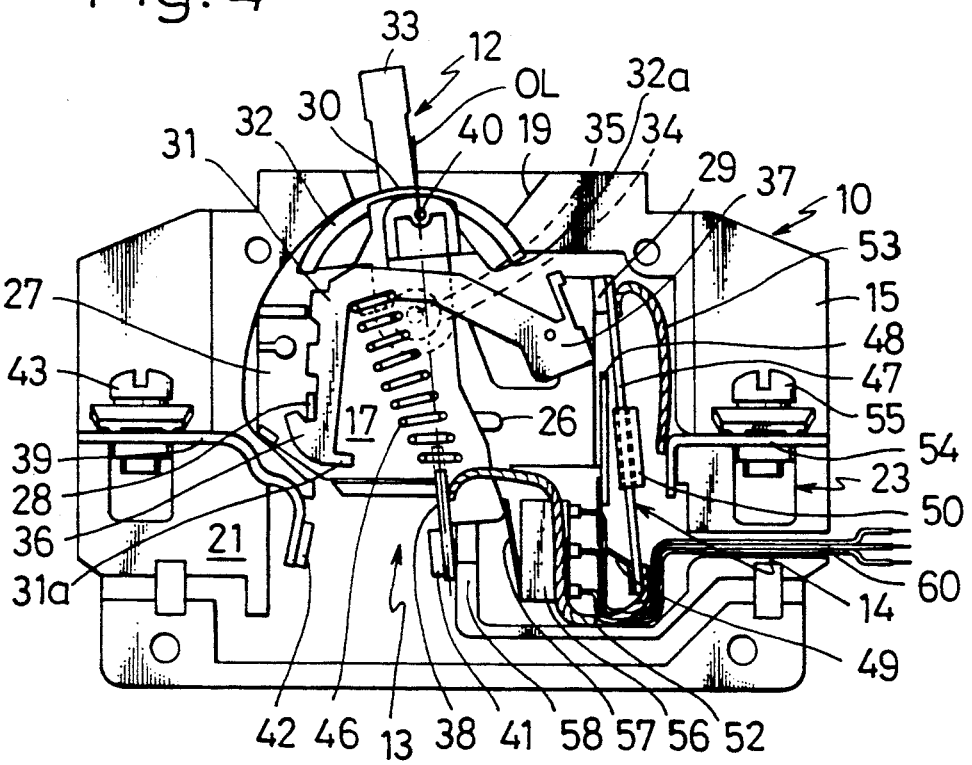
FIG. 4 is a similar elevation showing the interior of the circuit breaker in a tripped state due to direction of an abnormal current.

Further, when a short-circuit current is caused to flow through the circuit breaker 10 with the switching contact means 13 in the contact closing state, a large current passing through the bimetal plate 47 due to the short-circuit current causes a magnetic circuit to be formed through the attracting plate 50 made of magnetic material and secured to the bimetal plate 47 and the tripping plate 48. The tripping plate 48 is thereby attracted to the attracting plate 50 so that the tripping plate 48 will be displaced in the direction causing it to separate from the switching contact means 13. Consequently, the locking part 37 at the other end of the cradle 31 disengages from the locking hole 51 of the tripping plate 48 so that, substantially in the same manner as during a continuous overcurrent, the cradle 31 and movable contact arm 38 are actuated so that the switching contact means 13 is forcibly opened into the tripped state as shown in FIG. 4.

The detection switch 56 detects the forcibly opened state of the movable contact arm 38 as tripped due to the occurrence of an overcurrent or short-circuit current transmit the detection signal. Even when the tripping plated 48 is displaced due to the overcurrent or short-circuit current, the tripping plate 48 returns to its original position in response to restoration of the bimetal plate 47 due to cooling or to release of the tripping plate 48 from the magnetic attraction, at the time when the abnormal current flowing through the circuit breaker 10 returns to a normal value. At this time, the handle 30 is rotated clockwise in the tripped state of FIG. 4, the cradle 31 is urged by a lower end 32*a* of the barrel part 32 of the handle 30 to be rotated in the clockwise direction so as to be able to engage the locking part 37 at the other end of the cradle 31 in the locking hole 51 of the tripping plate 48, and the circuit breaker 10 can be eventually restored from the tripped state to the normal contact opening state of FIG. 3.

Figure 5:
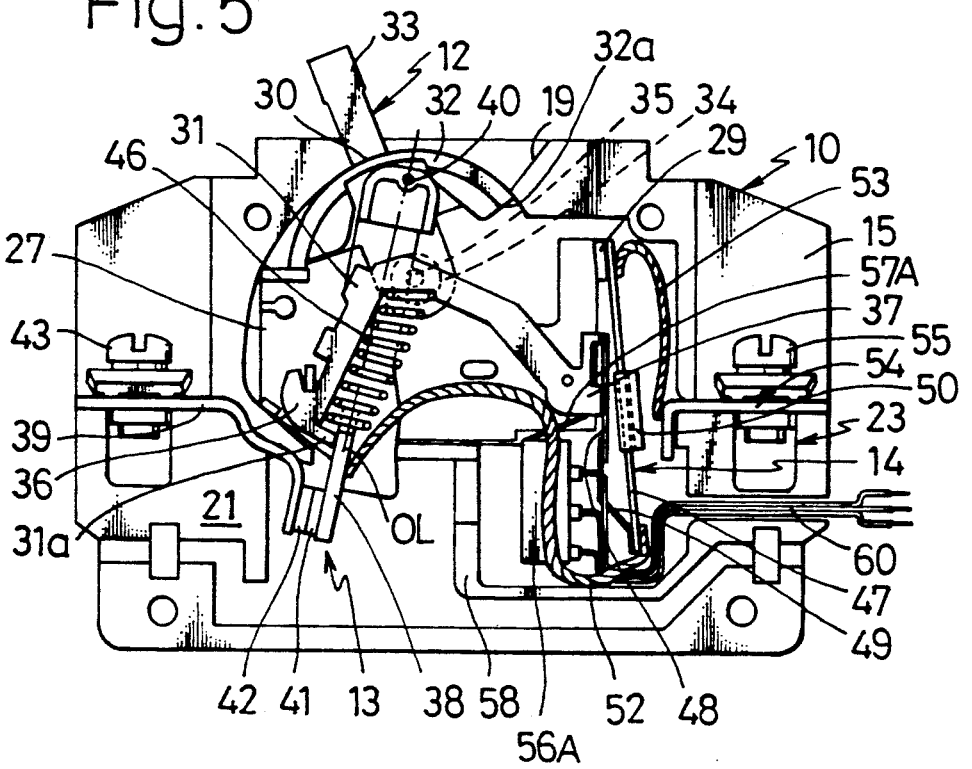
FIG. 5 is a similar elevation of another embodiment of the circuit breaker according to the present invention, showing its interior with the contacts closed and with the cover removed.
Figure 6:
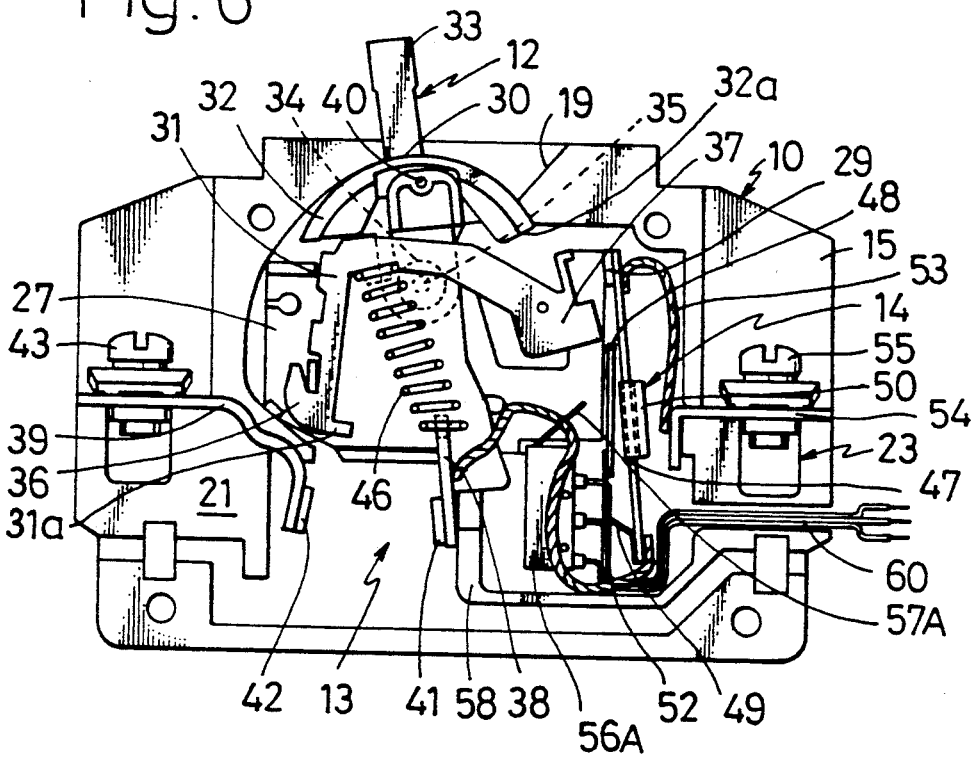
FIG. 6 is a similar elevation of the circuit breaker of FIG. 5 in detection of an tripped state due to the abnormal current.

FIGS. 5 and 6, show another embodiment of the present invention. The actuator 57A of the detection switch 56A in this embodiment is extended to be normally engageable with the cradle 31. That is, so long as the locking part 37 at the other end of the cradle 31 is engaged in the locking hole 51 of the tripping plate 48, the actuator 57A of the detection switch 56A is positioned to be in resilient contact with a lower edge part of the cradle 31 but to be released from this contact when the locking part 37 of the cradle 31 disengages from the hole 51 to be urged into the tripped state so that, when the contact means 13 shifts from the contact closing state of FIG. 5 to a tripped state as shown in FIG. 6 in which the actuator 57A is released from the contact, a signal denoting the tripped state thus detected can be transmitted out of the detection switch 56A. The structure and operation of this embodiment are otherwise the same as for the embodiment of FIGS. 1 to 4, and the same constituent members as in the embodiment of FIGS. 1 to 4 are denoted by the same reference numerals in FIGS. 5 and 6.

Figure 7:
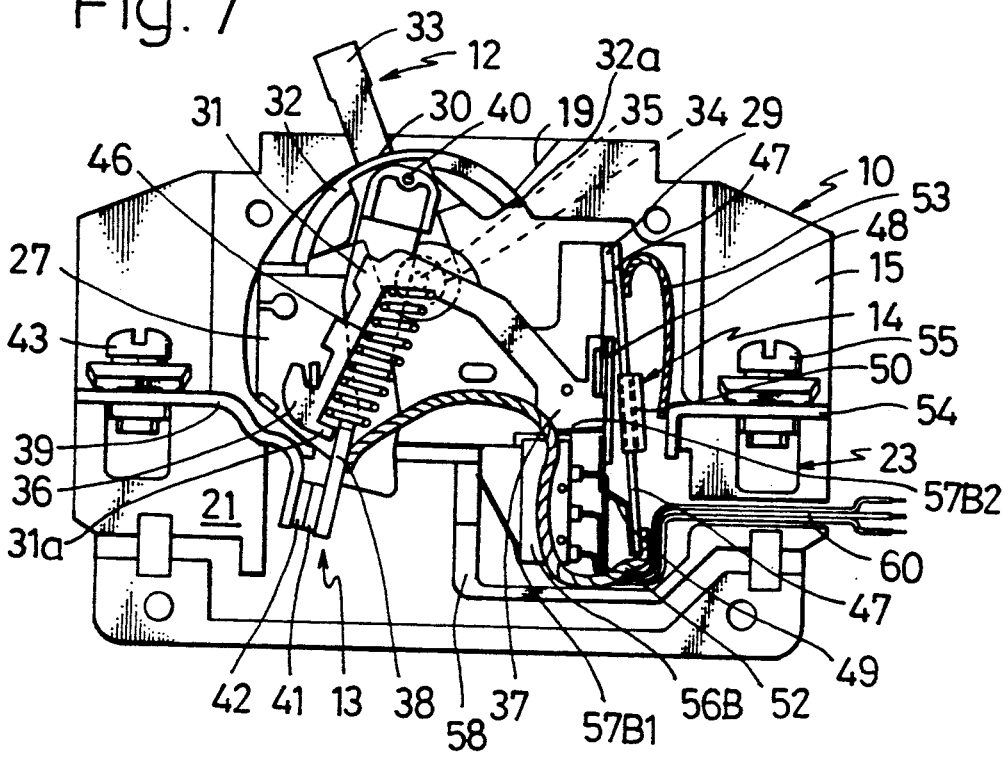
FIG. 7 is a similar elevation of another embodiment the circuit breaker according to the present invention showing its interior with the contact closed and with the cover removed.

FIG. 7 shows a further embodiment. In this embodiment, the detection switch 56B is provided with two actuators 57B1 and 57B2. The first actuator 57B1 is engageable with the movable contact arm 38 in the contact opening state while the second actuator 57B2 is engageable with the cradle 31 in the stationary state. According to this embodiment, therefore, it is possible to transmit out of the detection switch 56B signals denoting the opening and closing states of the switching contact means 13 with the engagement and disengagement of the first actuator 57B1 with and from the movable contact arm 38, in the same manner as in the embodiment of FIGS. 1 to 4, as well as further signals indicative of whether or not the switching contact means 13 is in the tripped state with the engagement and disengagement of the second actuator 57B2 with the cradle 31. The structure and operation of this embodiment are otherwise the same as for the embodiment of FIGS. 1 to 4, and the same constituent members as in the embodiment of FIGS. 1 to 4 are denoted by the same reference numerals.

According to the above-described circuit breaker of the present invention, assembly can be automated since assembly sequences such as have been described are enabled by the use of the compressive turning spring 46 disposed between the both spring bearing parts 44 and 45 particularly for the interlocking between the cradle 31 and the movable contact arm 38, and the ease of mass-production of the circuit breaker can be increased. It will be also appreciated that the use of the detection switch allows the opening and closing state of the contact means 13 as well as the presence and absence of the tripped state of the switching contact means 13 to be detected for discrimination of the state at a remote position, while the switch is disposed in any vacant space aside the cradle 31 and movable contact arm 38, so that the intended object can be realized without enlarging the casing 11 of the circuit breaker 10.

In the present invention, it is possible to adopt various design modifications. For example, the first and second reference positions and coupling positions of the handle and movable contact arm, i.e., the operational line and spring turning position are not restricted to those described with reference to the illustrated embodiments, but can be varied so long as the foregoing arrangement and function can be attained. While in the embodiment of FIG. 7, the contact opening and closing state as well as the presence and absence of the tripped state are detected by means of the single detection signal, it is of course possible to attain such detection with a pair of detection switches each having a single actuator.

What is claimed is:

1. A circuit breaker comprising:

a handle having a coupling part;

a movable contact arm rotatably supported by said coupling part of said handle and having a first spring bearing part and a movable contact;

a fixed contact with respect to which said movable contact is engageable and disengageable;

a cradle having a second spring bearing part and a first locking part;

an abnormal current detecting means having a second locking part for releasably locking said first locking part of said cradle; and a turning spring comprising a compression spring compressed between said first and second spring bearing parts for pressing said movable and fixed contacts against one another when said first locking part of said cradle is locked to said second locking part of said abnormal current detecting means and for turning to rotate said movable contact arm and cradle in a direction disengaging said movable contact from said fixed contact when said first locking part of said cradle is released from said second locking part of said abnormal current detecting means.

2. The circuit breaker of claim 1 which further comprises a casing including a casing body having a housing chamber a cover fitted to said casing body, wherein said handle, said movable contact arm, said fixed contact, said cradle, said abnormal current detecting means, and said turning spring are disposed inside said housing chamber.

3. The circuit breaker of claim 2 which further comprises:

a mounting frame installed in said housing chamber of said casing body; and a shaft pin installed between said casing body and said mounting frame for pivotably supporting said handle, said mounting frame having a pivoting projection for pivotably supporting said cradle and having a mounting projection on which said abnormal current detecting means is mounted.

4. The circuit breaker of claim 3 wherein said first and second spring bearing parts are provided respectively at a central part of said movable contact arm and a central portion of said cradle.

5. The circuit breaker of claim 2 which further comprises a state detecting switch disposed in said housing chamber for detecting an operating state of said circuit 6. The circuit breaker of claim 5 wherein said state detecting switch is disposed for detecting movement of said movable contact arm between a closed position and an open position.

7. The circuit breaker of claim 2 wherein:

said movable contact arm is rotatable in a first rotational direction from a closed position to an open position; and said cradle has a pivoting part engaged with said pivoting projection of said mounting frame and a leg part projecting from said cradle close to said pivoting part of said cradle, said cradle being rotatable about said pivoting projection in the first rotational direction from a locked position to a tripped position, said leg part acting to forcibly urge said movable contact arm to open said contacts when said cradle rotates from said locked position to said tripped position.

8. The circuit breaker of claim 3 wherein:

said movable contact arm is rotatable in a first rotational direction from a closed position to an open position; and said cradle has a pivoting part engaged with said pivoting projection of said mounting frame and a leg part projecting from said cradle close to said pivoting part of said cradle, said cradle being rotatable about said pivoting projection in the first rotational direction from a locked position to a tripped position, said leg part acting to forcibly urge said movable contact arm to open said contacts when said cradle rotates from said locked position to said tripped position.

9. The circuit breaker of claim 5 wherein said state detecting switch is disposed for detecting movement of said cradle between a locked position and a tripped position.

10. The circuit breaker of claim 5 wherein said state detecting switch comprises a switch body having a first actuator and a second actuator, said first actuator being responsive to movement of said movable contact arm between a closed state and an open state, and said second actuator being responsive to movement of said cradle between a locked position and a tripped position, whereby said state detecting switch can distinguish between an open state, a closed state, and a tripped state of said circuit breaker.

11. A circuit breaker comprising:

a housing;

a handle supported by said housing and pivotable between an open position and a closed position;

a fixed contact disposed in said housing;

a movable contact arm pivotably connected to said handle for pivoting between an open position and a closed position as said handle is pivoted between its open position and its closed position;

a movable contact mounted on said movable contact arm, said movable and fixed contacts contacting one another when said movable contact arm is in its closed position and being separated when said movable contact arm is in its open position;

a cradle pivotably supported in said housing and pivotable about a pivot point between a locked position and a tripped position and having an engaging portion for engaging said movable contact arm and forcibly pivoting said movable contact arm to its open position when said cradle pivots to its tripped position;

current detecting means for sensing a current and preventing said cradle from rotating from its locked position when the current is below a prescribed level and for releasing said cradle when the current exceeds the prescribed level; and a compression spring compressed between said cradle and said movable contact arm and having an end connected to said cradle at a point remote from said pivot point, said spring exerting a force pressing said contacts against one another and biasing said cradle towards its tripped position when said movable contact arm is in its closed position and said cradle is in its locked position.

* * * * *